US012723412B2

(12) United States Patent
Woolvine et al.

(10) Patent No.: US 12,723,412 B2
(45) Date of Patent: Sep. 1, 2026

(54) COVERING ELEMENT FOR FLOOR COVERING, A FLOOR COVERING AND A METHOD FOR INSTALLING A FLOOR COVERING

(71) Applicant: !Obac Limited, Tadley Hampshire (GB)

(72) Inventors: Paul Woolvine, Tadley Hampshire (GB); Ian Spreadborough, Tadley Hampshire (GB)

(73) Assignee: IOBAC Limited, Little London (GB)

( * ) Notice: Subject to any disclaimer, the term of this patent is extended or adjusted under 35 U.S.C. 154(b) by 189 days.

(21) Appl. No.: 18/289,165

(22) PCT Filed: Apr. 29, 2022

(86) PCT No.: PCT/IB2022/053981
§ 371 (c)(1),
(2) Date: Nov. 1, 2023

(87) PCT Pub. No.: WO2022/234411
PCT Pub. Date: Nov. 10, 2022

(65) Prior Publication Data

US 2024/0218675 A1 Jul. 4, 2024

(30) Foreign Application Priority Data

May 6, 2021 (EP) ..... 21172590

(51) Int. Cl.
*E04F 15/08* (2006.01)
*E04F 13/30* (2006.01)
(Continued)

(52) U.S. Cl.
CPC .... *E04F 15/02144* (2013.01); *E04F 15/0215* (2013.01); *E04F 15/082* (2013.01); *E04F 13/0883* (2013.01)

(58) Field of Classification Search
CPC ..... E04F 15/02144; E04F 15/0215; E04F 15/082; E04F 15/02133; E04F 15/02155;
(Continued)

(56) References Cited

U.S. PATENT DOCUMENTS 5,271,200 A * 12/1993 Witt ..... G09F 19/22 52/391
5,927,033 A * 7/1999 Kreckl ..... E04F 13/0883 52/390

(Continued)

FOREIGN PATENT DOCUMENTS

WO WO2010/072704 7/2010
WO WO2021/038386 3/2021

OTHER PUBLICATIONS

PCT/IB2022/053981. International Search Report and Written Opinion. May 27, 2022.
EP21172590.0. Extended European Search Report. Nov. 9, 2021.

*Primary Examiner* — Kyle J. Walraed-Sullivan
(74) *Attorney, Agent, or Firm* — Joseph E. Maenner; Maenner & Associates, LLC

(57) ABSTRACT

A method for installing a floor covering comprising the steps of:—providing a thinset composition (21) on top of a subfloor (20)—providing a covering element (1) on top of said thinset composition (1) when the thinset composition (21) is in an uncured or partially cured state, wherein said covering element (1) has an upper side and a lower side (1*b*) and is removably attached to an intermediate layer (14) at its lower side (1*b*), so that said intermediate layer (14) enters into contact with the thinset composition (21).

14 Claims, 2 Drawing Sheets

(51) Int. Cl.
*E04F 15/02* (2006.01)
*E04F 13/08* (2006.01)

(58) Field of Classification Search
CPC ..... E04F 13/0883; E04F 13/30; E04F 13/088; E04F 21/1866; E04F 2201/06; E04F 2201/07; Y10S 52/04; Y10S 428/90; B32B 2307/208
USPC ..... 52/DIG. 4, 747.11
See application file for complete search history.

(56) References Cited

U.S. PATENT DOCUMENTS

| | | | | |
|---|---|---|---|---|
| 8,656,674 | B1 * | 2/2014 | Woodward | E04F 13/142 52/388 |
| 2008/0202053 | A1 * | 8/2008 | Guy | E04F 15/02144 52/391 |
| 2012/0000156 | A1 * | 1/2012 | Esposito | E04F 13/0883 52/578 |
| 2018/0257340 | A1 * | 9/2018 | Bassi | B32B 21/04 |
| 2019/0390466 | A1 * | 12/2019 | Lautzenhiser | E04F 15/02144 |

* cited by examiner

COVERING ELEMENT FOR FLOOR COVERING, A FLOOR COVERING AND A METHOD FOR INSTALLING A FLOOR COVERING

BACKGROUND OF THE INVENTION

The present invention relates to a covering element for floor covering and floor covering, preferably comprising a hard and/or fragile element, for example a ceramic covering element. The present invention also relates to a method for installing a floor covering.

In particular, the present invention relates floor covering comprising a ceramic covering element that are installed in a removable manner.

Covering elements of hard and/or fragile material, such as ceramic covering elements, are conventionally fixed to the screed by means of a mortar, usually a cement mortar. Additionally, in order to ensure that the covering is waterproof, a grout is used to fill the grout gap, that is to say the space between covering elements. Consequently, after setting of the mortar, it is extremely difficult to remove the covering, because the floor has to be demolished. Demolition also results in the destruction of the covering elements themselves. After demolishing of the floor covering the screed has to be restored.

Floating laying is a laying system that does not involve any attachment between the covering element and the screed, and it is used to speed up and simplify the laying of covering elements. This system is widely used for wood, laminate or parquet covering elements. For laying covering elements of fragile material such as ceramic covering elements by floating laying, it is necessary to use a reinforcing element to increase the toughness of the covering element. This is because the covering element is not fixed to the screed, and therefore the toughness of the covering element itself is not sufficient to withstand even minor impacts. WO 2010/072704 describes a method for reinforcing ceramic covering elements for floating laying. However, although WO 2010/072704 suggests how to reinforce covering elements for floating laying, it does not suggest how to lay them.

Floating installation has also the drawback of requiring a perfectly levelled screed, so that it is normally necessary to perform a preliminary operation for levelling the subfloor for example by using expensive self-levelling mortar composition that require a longer setting time compared to standard composition.

The present invention proposes, in the first place, to provide an alternative floor covering, and an innovative method for installing a floor covering, which, according to some of its embodiments, is intended to resolve one or more of the problems arising from the prior art.

BRIEF SUMMARY OF THE INVENTION

Consequently, the present invention, according to a first independent aspect thereof, relates to method for installing a floor covering comprising the steps of: providing a thinset composition on top of a subfloor, providing a covering element on top of said thinset composition when this thinset composition is in an uncured or partially cured state, with the characteristic that said covering element has an upper side and a lower side and it is removably attached to an intermediate layer on its lower side, so that said intermediate layer enters in contact with the thinset composition. As a result of this solution, the covering elements may be laid in a removable and floating installation since after setting of the thinset composition, only the intermediate layer is fixed to the thinset itself, so that dismantling, and substitution of the floor covering is simplified. Moreover, since the covering elements are disposed on the floor while the thinset is in an uncured or in a partially cured state, it is possible to adjust the positioning of the covering elements and/or the distribution of the thinset in such a way to obtain a levelled subfloor that is suitable for floating installation of the covering element, in particular it is provided a levelled subfloor for the renewal of the floor covering. It is to be noted that since the subfloor is made flat during the installation of the first, original, floor covering it is possible to save time, since with one operation two results are obtained: a levelled subfloor and the installation of a floating floor. Preferably, after the setting time of the thinset composition the intermediate layer is fixed to the thinset itself, wherein with "fixed" it is meant that the intermediate layer adheres to the thinset in such a way that it is not possible to resolve the adhesion without damaging the intermediate layer. It is noted that in this way it is possible with only one process step to achieve three goals, namely: levelling the screed, fixing the intermediate layer to the screed and installing the floor covering. Since the intermediate layer adheres directly to the thinset it is not necessary to use external fixing means like other adhesives or nails. It is also to be noted that since the intermediate layer is fixed to the screed after uninstallation of the floor elements it is immediately available for the installation of new covering elements.

According to the preferred embodiment of the invention the covering element can be attached to the intermediate layer via magnetic means. For example, the covering element can have a magnetic or magnetic receptive element on its lower side and said intermediate layer can be, or can comprise, a magnetic or magnetic receptive layer. Magnetic means provides for a perfectly resolvable attachment between the covering element and the intermediate layer. Moreover, magnetic means have the advantage of not being susceptible of dirt and powder, like glues or other adhesives, that are normally present in the construction sites. Magnetic means have also the advantage that the magnetic force remain substantially unchanged over time, contrary to what happens to most of the adhesive. In any case, it is not excluded that in alternative embodiments the covering element can be attached to the intermediate layer via other means, like for example glues or adhesives. Moreover, in this way once the covering element is removed from the floor covering the magnetic or magnetic receptive layer remain fixed to the screed and it is ready to receive another covering element.

It is preferred that the covering element has a magnetic receptive element at is lower side instead of a magnetic element. In fact, magnetic receptive elements are normally cheaper than magnetic elements, so that the substitution of the floor covering become more convenient. In the preferred embodiment the magnetic receptive element can comprise a metallic sheet, for example made of steel.

In the preferred embodiment the intermediate layer is a magnetic sheet that is configured for being removably attached to the magnetic receptive element of the of the covering element. In the preferred embodiment the intermediate layer comprises a polymeric sheet with magnetic particles, for example of strontium ferrite, embedded therein. The intermediate magnetic layer is able to generate a magnetic field on at least one of its main surfaces, preferably on both its surfaces.

According to the preferred embodiment of the invention, the intermediate magnetic or magnetic receptive layer can comprise, on at least one of its main surfaces, an adhesive coating preferably a low-tack adhesive coating. In this way it is possible to combine the magnetic attraction with a low-tack adhesion to improve the adhesion between the covering element and the intermediate layer. Moreover, the combination of the magnetic attraction with the low-tack adhesion allows the reduction of the intensity of the magnetic field thereby reducing the cost of the intermediate layer. Said adhesive coating can comprise, for example, a polyurethane resin, polyaspartic resin, acrylic resin, epoxy resin.

The intermediate layer can comprise a unique sheet of in order to minimize its thickness and its contribution to the overall thickness of the floor covering. Anyway, according to alternative embodiments the intermediate layer can comprise multiple sheets wherein one or more of these sheets can provide additional functionalities to the layer, like sound insulating sheet, moisture barrier etc. In any case, it is not excluded that said additional functionalities are obtainable also by intermediate layer having a unique sheet. Preferably, the intermediate layer shows a thickness of at least 0.2 mm, preferably at least 1 mm. It is also preferable that the intermediate layer shows thick ness of maximum 2 mm, preferably maximum 1.5 mm. The inventors have found that an intermediate layer having a thickness between said maximum and minimum values may show good behavior in reducing the telegraphing issue while limiting its impact on the overall thickness and cost of the floor covering. The intermediate layer can be made of polymeric material, preferably elastomeric material, for example polyolefin based elastomer, like chlorinated polyethylene (CPE).

Preferably, the intermediate layer shows shape and/or dimension substantially corresponding to the shape and/or dimension of the covering element, in particular of the lower surface thereof. For example, the intermediate layer can have a dimension that is suitable to cover at least the 80% of the lower surface of the covering element. In this way, each covering element of the floor covering can have its respective intermediate layer and can be packed together with it so as to be immediately ready for instalation and so that the intermediate layer and the covering element are installed in a unique step.

The thinset composition can be a cement-based composition, a resin-based composition or, preferably a combination of an organic-based composition and resin-based composition. The cement-based composition can comprise one or more of cementitious component like, Portland cement, calcium-based cement, for example calcium-sulphate based cement, aluminum-based cement, and/or fillers, preferably inorganic fillers, like clays or silica. The resin-based composition can comprise acrylic or epoxy composition.

In the preferred embodiment, the thinset composition can comprise a magnetic or magnetic receptive element, preferably magnetic receptive particles. In the preferred embodiment said magnetic receptive particles can comprise ferro silicon particle and/or magnetite. Thank to this solution it is possible to improve to further improve the attraction between the intermediate magnetic layer and the thinset composition. Moreover, in this way, since the magnetic receptive particles are attracted by the magnetic intermediate layer it is ensured that the intermediate layer adheres to the thinset on substantially the entirety of its lower surface preventing the formation of voids between the intermediate layer and the thinset. Thanks to the additional magnetic attraction the thinset composition adapts itself to the shape and conformation of the lower surface of the intermediate layer and of the covering element, which is adhered to the intermediate layer, thereby becoming as flat as the lower surface of the covering element.

In the preferred embodiment, the thinset composition can comprise at least the 20% wt (by weight), preferably at least the 30% wt of cement-based composition, at least 20% wt (by weight), preferably at least the 30% wt of resin-based composition, and at least 20% wt (by weight), preferably at least the 30% wt of magnetic receptive or magnetic element.

Preferably the thinset composition has a setting time below 10 h (hours), more preferably below 7 h, even more preferably below 5 h. In this way it is provided a method wherein in less that 10 h, i.e in one working day, it is possible to start from an irregular screed that needs to be levelled and achieve a complete walkable floor that can be easily substituted, wherein normally this is achieved in at least two working days. It is also preferable that the thinset composition has a setting time above 1 min (minute), preferably above 30 min, even more preferably above 1 h. In this way it can be provided enough time for installing the covering element before the thinset cures.

The covering element can preferably comprise a tile made of an hard and/or brittle material like ceramic, natural stone, artificial stone, glass or glass-ceramic material, mineral-based tile (for example MgO tile), cement based tile. Anyway, in less preferred embodiment the covering element can comprise a tile or panel made of other materials like wood-based laminate, LVT, SPC, carpet and wood. In the most preferred embodiment the tile is made of ceramic material, for example porcelain (also called porcelaneous stoneware), red body (single fired), clinker or monoporosa (also called single fired wall covering element).

The tile of ceramic material may preferably comprise a body of ceramic material and an upper decorative surface that can be placed facing upward in use. Said upper surface may have at least one coating layer, for example a glaze, an engobe, a glazed engobe and/or a grit. The upper surface may have a pattern, for example a solid color or a design or graphic, which is, for example, printed, preferably by digital printing. According to a preferred embodiment of the invention, the body of the tile has a color which is similar, or preferably identical, to that of the pattern, for example with the same color as the glaze.

The covering element may have a thickness of between 4 and 30 mm, preferably between 5 and 12 mm.

In the preferred embodiment wherein the tile is made of a brittle material, the covering element preferably comprises a reinforcing element that is configured to improve the mechanical strength of the tile; in particular, it is configured to increase the toughness of the tile. Preferably, the reinforcing element is associated with, for example fixed, or preferably glued, to the lower surface of the tile. Preferably, the reinforcing element is glued to the tile by means of an adhesive, either thermosetting or thermoplastic, for example an epoxy, polyurethane, polyester, acrylic and/or hotmelt glue. If glues are used for fixing the reinforcing element to the tile, it is preferable for the lower surface of the covering element to be substantially smooth or to have a structure with relief elements and/or incisions as described above. If the lower surface comprises said structure of relief elements and/or incisions, the structure may preferably comprise relief elements and/or incisions arranged in the form of lines and/or rows, for example substantially parallel to one another. This is because such structures make it possible to contain the glue and prevent it from overflowing over the edges of the covering element and/or of the reinforcing element during gluing. With the aim of improving the efficacy of the reinforcing layer, the lower surface of the tile, can be substantially smooth, for example being free of structures such as relief elements and/or incisions. This is because the inventors have observed that the reinforcing element has a more marked effect when associated with a lower surface of the covering element that is substantially smooth. Said structure of the lower surface of the tile is also known as the "mark" and is commonly used to limit the material for forming the body of the tile. In this case, we speak of a "material saving" mark and it is distinguished from other types of mark by the thickness of the structure which may be beyond a millimeter in thickness. Therefore, according to another embodiment, the lower surface of the covering element may comprise a structure having relief elements and/or incisions with a thickness of less than 1 mm, preferably less than 0.5 mm, or even more preferably less than 0.2 mm.

The reinforcing element may be made according to various options, of which three preferred options are described below.

According to a first option, the reinforcing element can comprise a metal sheet, made for example of steel, preferably galvanized or stainless steel. Preferably, the metal sheet is configured to generate a compressive state in the covering element, starting from the lower surface of the covering element. In other words, the tile is compressed by the metal sheet. Thus, as the covering element is in a compressive state, a significant improvement in the impact resistance is obtained, since the compressive state impedes crack propagation. To achieve this objective, the metal sheet is initially put under tension (stretched or elongated) by means of mechanical or, preferably, thermal stretching, and is then attached under the covering element while it is still in the elongated state. The stretching is then released, by interrupting the mechanical stressing or cooling the metal sheet, so as to put the covering element under compression.

According to a preferred embodiment, the metal sheet has a coefficient of thermal expansion that is greater than the coefficient of thermal expansion of the covering element. As a result of this solution, the metal sheet can be stretched by heating so as to expand in a substantially uniform manner in all directions. After the sheet is placed under the covering element, it may be cooled so as to contract and put the covering element under compression.

Preferably, the metal sheet has a Young's modulus that is greater than the Young's modulus of the covering element, being for example two or three times the Young's modulus of the covering element. Thus, when the elongated state of the metal sheet is released, the sheet can effectively put the covering element under compression. For example, said sheet is applied according to the method described in the international application WO 2010/072704, which is incorporated herein by reference.

In a preferred embodiment, the metal sheet has a thickness of between 0.05 mm and 1 mm, preferably between 0.05 mm and 0.5 mm, or even more preferably between 0.1 and 0.2 mm, for example 0.12 mm. It should be noted that thicknesses of the sheet between 0.1 and 0.2 mm are preferably used for covering elements having a thickness of less than 15 mm, while for covering elements having a thickness of more than 15 mm it is preferable to use a sheet having a thickness of between 0.2 and 0.4 mm.

Additionally, the reinforcing element may comprise one or more protective coverings, each capable of covering the metal sheet at least partially, or preferably totally, so as to protect it from corrosion.

In the most preferred embodiment of the invention the reinforcing element made of a metal sheet can be magnetic receptive, for example may advantageously have ferromagnetic and/or paramagnetic characteristics, preferably ferromagnetic, so that the reinforcing element and the magnetic receptive element of the covering element are the same. Thus, the metal sheet can both meet the requirements for toughness of the covering element and contribute actively to installation of the covering element to the screed.

According to a second option for the reinforcing element, the latter may comprise a layer of glass fiber, for example a glass fiber texcovering element, mesh or mat. The glass fiber may be woven or nonwoven. The reinforcing element may comprise glass fibers arranged in a number of planes, for example with a different orientation in each plane. Alternatively, or in combination with the glass fiber, it is possible to use carbon fibers, polymeric fibers such as aramid or polyamide fibers, or ceramic fibers such as boron or silicate fibers. The inventors have found that the fiber reinforcing element enables the rigidity of the covering element to be improved so as to impede crack propagation and thus improve bending resistance.

According to a third option, the reinforcing element may comprise a rigid element fixed to the lower surface of the tile via an adhesive. The rigid element can have pa Young modulus above 2 GPa, more preferably above 5 GPa. Moreover, preferably the can have a thickness above 2 mm, more preferably above 4 mm. Said rigid element is preferably made of plastic material, preferably thermoplastic. For example, said rigid element is made of PVC or PP, preferably rigid PVC comprising a mineral filler (preferably calcium carbonate) in a quantity preferably above 30% wt, more preferably above 60% wt. In alternative embodiments said rigid element can be made of mineral based material like MgO boards. In particular, according to this third option for forming the reinforcing element, the latter and the supporting element may be formed as described in U.S. patent application Ser. No. 16/278,560, which is incorporated herein by reference. According to this third option for the reinforcing element, the resin may be capable of permeating open pores of the tiles. Preferably, said resin may show a viscosity of less than 1000 mPas at 20° C. in a non-set state, for example between 600 and 200 mPas. Because of this very low viscosity, the resin during the application can permeate said open pores so as to create a kind of composite resin-ceramic material in the proximity of the lower surface of the tile.

Preferably, the reinforcing element has substantially the same horizontal shape and/or size (in plan view) as the tile. Additionally, the tile and the reinforcing element are superimposed so that, in use, the reinforcing element is substantially concealed by the tile. According to the preferred embodiment, the reinforcing element has a slightly smaller horizontal size (in plan view) than that of the lower surface of the tile, for example in such a way that the edges of the reinforcing element do not project beyond the edges of the tile. Thus, especially if the reinforcing element comprises a thin metal sheet, the possibility of an operator cutting himself on the sheet is prevented.

In some embodiment the covering element can comprise a lining of at least one of its edges, in particular on one of the edges of the tile. As a result of this solution, the covering elements, especially the tile thereof, may be laid in a floating installation and may also be placed in direct contact with one another so that there is no need to use any grout. Consequently, the covering elements may be easily laid and removed just as easily, without being subjected to any damage, so that they can be re-used. Indeed, the lining protects the edges of the tiles so that they can touch one another without the risk of chipping.

Preferably, the lining could be provided on a plurality of edges of the covering element, for example on at least two successive edges. Thus, by positioning the covering elements in the correct orientation, the linings are sufficient to protect all the edges of the covering elements, yielding savings in the material for the lining and reducing the thickness of the joint. In the preferred embodiment of the invention, however, the lining may be provided on all the edges of the covering element, thereby simplifying the laying operation because there is no need to conform to a specific orientation. According to one embodiment, the lining may be provided on said plurality of edges in the form of separate elements, or in the form of a single element bent back onto a plurality of edges. In the second case, the lining is provided in a form that provides an aesthetically pleasing effect of continuity and that may also contribute to the sealing of the joint. In the first case, however, it is operationally simpler apply a number of separate elements, which may also have different characteristics.

According to one embodiment of the invention, the lining may be made of polymeric material, preferably thermoplastic. For example, the lining may be made of PVC, ABS or PE. The lining may be made of rigid or compressible material; for example, the lining may be made of elastomeric material.

The lining may have a thickness of less than 1.5 mm, or preferably less than 1 mm, for example 0.6 mm. This is because a thin lining not only contains the cost of the material but also enables the thickness of the joint between the covering elements to be reduced, thus improving the overall appearance of the floor. The lining may also be capable of covering only part of the thickness of the covering element, for example at least half or preferably at least two thirds of said thickness, or may be capable of covering the whole thickness of the covering element.

Preferably, the lining has a color capable of imitating, or preferably identical to, the color of the upper surface and/or of a body of the tile.

The lining may be applied to the respective edge by any lining method; for example, the lining may be glued to the edge or may be extruded directly onto the edge of the covering element.

According to a preferred embodiment, the covering element comprises at least one edge having a lower bevel. Thus, when in use, the covering elements may be installed in direct contact with one another, and the edges are not in contact over the whole thickness of the covering element but only over a limited portion, so as to reduce the friction during the removal of a covering element, thus simplifying the uninstallation of the floor. The lower bevel also enables the point of contact between the edges of the covering elements to be kept at a position near the upper surfaces of the covering elements, so as to provide an effect of substantial continuity on the surface of the floor. In practice, lower bevel is taken to mean that the covering element, in particular the tile thereof, has a cross section that tapers toward the lower surface. In other words, the edge of the tile, is inclined, in use, at an acute angle to the horizontal. For example, the lower bevel may form an angle with the horizontal which is preferably less than 90°, or preferably less than 85°, for example between 60° and 85°. According to a preferred embodiment of the invention, the bevel may preferably occupy a lower portion of said edge, for example at least a third, or preferably at least a half, for example two thirds of the thickness of the covering element. Preferably, the lower bevel may be on a plurality of edges of the covering element, for example on at least two successive edges, or even more preferably on all the edges of the covering element.

According to a preferred embodiment, the covering element can further comprise an edge having an upper bevel. Thus, when in use, the covering elements may be installed in direct contact with one another, and the edges are not in contact over the whole thickness of the covering element but only over a limited portion, so as to reduce the friction during the removal of a covering element, thus simplifying the uninstallation of the floor. Moreover, the upper bevel makes it possible to conceal any differences in level or differences in height among the covering elements. In the conventional installation, these differences in level are concealed or masked by the grout, and, as a general rule, the wider the grout, the easier it is to conceal the difference in level. The upper bevel therefore enables the covering elements to be placed together in contact while concealing the difference in level that would otherwise be emphasized by the direct contact between the covering elements. In practice, "upper bevel" is taken to mean that the covering element has a cross section that tapers toward the upper surface. In particular, at least an upper portion of said cross section is tapered toward the upper surface. In other words, said edge has an upper portion (that is to say, said upper bevel) which, in use, is inclined relative to the vertical. For example, the upper bevel may form an angle with the vertical which is preferably less than 90°, preferably less than 45°, or even more preferably less than 30°. According to a preferred embodiment of the invention, the upper bevel may preferably occupy an upper portion of said edge, for example less than two thirds, or preferably less than a half, for example one third of the thickness of the covering element. Preferably, the upper bevel may be on a plurality of edges of the covering element, for example on at least two successive edges, or even more preferably on all the edges of the covering element.

According to the preferred embodiment, the lining is provided on at least one of the lower bevel and the upper bevel, preferably the lower bevel.

In alternative embodiment of the invention, the method can comprise the step of grouting the joints between the edges of the covering elements. In this case, the covering element can be free from the lining and, possibly from the upper and/or lower bevel.

Preferably the grout can be made of polymeric material, for example acrylic-epoxy- or silicone-based material. Cement-based grout can be used but are less preferred. Indeed, polymer-based grout are preferred because of their higher flexibility.

Additionally, advantageously, said grouting step can be performed in such a way to prevent adhesion between the grout and the intermediate layer and/or the thinset composition, so as to facilitate the dismantling of the covering and the re-use of its components. This solution is particularly important in the case of intermediate layer that is magnetic or magnetic receptive. In fact, magnetic intermediate layer may have a relatively high cost, and by impeding the adhesion between the grout and the intermediate layer it is possible to replace the covering elements without requiring the replacement of the intermediate layer itself, thus reducing the costs of renewing the covering.

Adhesion between the grout and the intermediate layer may be prevented according to one or more of the options listed below, considered either singly or in combination with one another.

According to a first option for preventing adhesion of the grout, a physical barrier may be interposed between the grout and the intermediate layer and/or the thinset composition. Said barrier may comprise, for example, a film, a membrane or a sheet. The barrier may also comprise a thread or a tube, made of plastic for example, to be inserted into the grout gap between the edges of the covering elements before the application of the grout.

A second option for preventing adhesion between the intermediate layer and/or the thinset and the grout is to use a substance that chemically or physically prevents said adhesion. For example, this substance may be a releasing agent or a lubricant to be applied in the grout gap before the application of the grout; alternatively, it may be applied to the intermediate layer in the form of a surface coating.

According to a third option for preventing adhesion between the grout and the intermediate layer and/or the thinset, the floor covering may comprise an interstice between the underlay and the grout. For example, the grout may be applied so that it is fixed to the upper portions of the edges of the covering elements without coming into contact with the underlay. In this case, it is preferable to apply the grout in the form of a paste or gel. For example, the grout may be applied in a smaller quantity than that required to occupy the volume of the grout gap between the covering elements. Preferably, the grout can be injected with a so-called silicone gun or caulk gun so to have a better control on the quantity of grout to be delivered in the joint. Advantageously, the distance between the edges of the covering elements may be less than 4 mm, or preferably less than 3 mm, for example equal to or less than 2 mm. This increases the probability that the grout will be fixed to said edges without collapsing under its own weight toward the bottom of the grout gap, that is to say toward the underlay.

A second independent aspect of the invention provides a floor covering comprising a thinset composition on top of a subfloor, and a covering element on top of said thinset composition with the characteristic that said covering element is removably attached to an intermediate layer on its lower surface that is in contact with the thinset composition. It should be noted that "floor covering" denotes a system comprising the elements mentioned above and below for forming a floor covering, for example a kit comprising said elements, and not necessarily the installed covering. It is noted that the covering element, the intermediate layer, the thinset composition and the grout can comprise one or more of the features described above in relation to the first independent aspect.

According to its third independent aspect the invention relates to a covering element for floor covering comprising a lower side with the characteristic that a layer is removably attached to said lower side of the floor covering. Said layer preferably being the intermediate layer described above in relation to the first and second independent aspect. In this way, the covering element can be installed on the screed by means of a thinset composition, so as to form a levelled floor covering, but it can be easily removed thanks to the fact that said layer is only removably attached to it. It is noted that the covering element can comprise one or more of the features described above in relation to the first independent aspect.

BRIEF DESCRIPTION OF THE DRAWINGS

Further characteristics and advantages of the invention will be apparent from a perusal of the following description, provided by way of example and in a non-limiting way, with the aid of the figures shown on the attached sheets.

FIG. 1 shows an axonometric view of a covering element 1 for floors. The covering element has an upper side 1*a*, for example having a décor, and a lower side 1*b* adapted to face a subfloor. The covering element 1 comprises a tile 2 of ceramic material, for example porcelaneous stoneware, red body (single fired), monoporosa ceramic or clinker. The tile 2 may be replaced in an equivalent manner by a tile made of hard and/or fragile material such as glass, glass-ceramic, cement, and/or natural stone.

The tile 2 has a substantially rectangular shape, square for example, and has edges 3 and a decorative upper surface 4. The upper surface 4 comprises a pattern 5 which, for example, simulates wood, natural stone or cement. Preferably, the pattern 5 is printed by digital printing.

Figure 1:
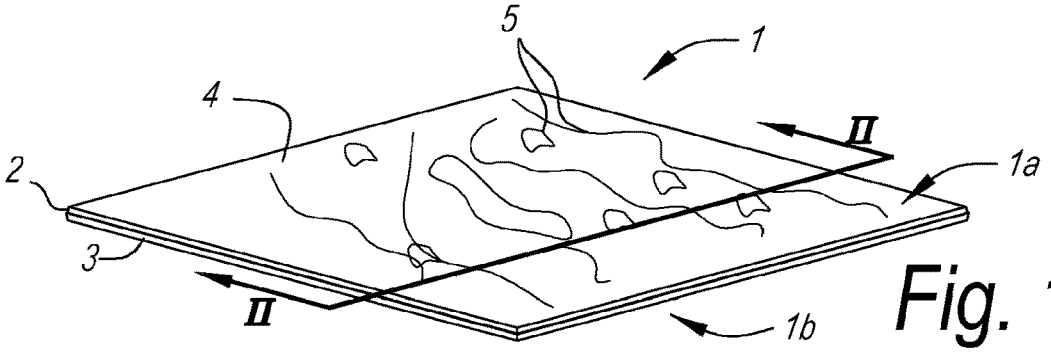
FIG. 1 schematically shows an axonometric view of a covering element according to an aspect of the invention.
Figure 2:
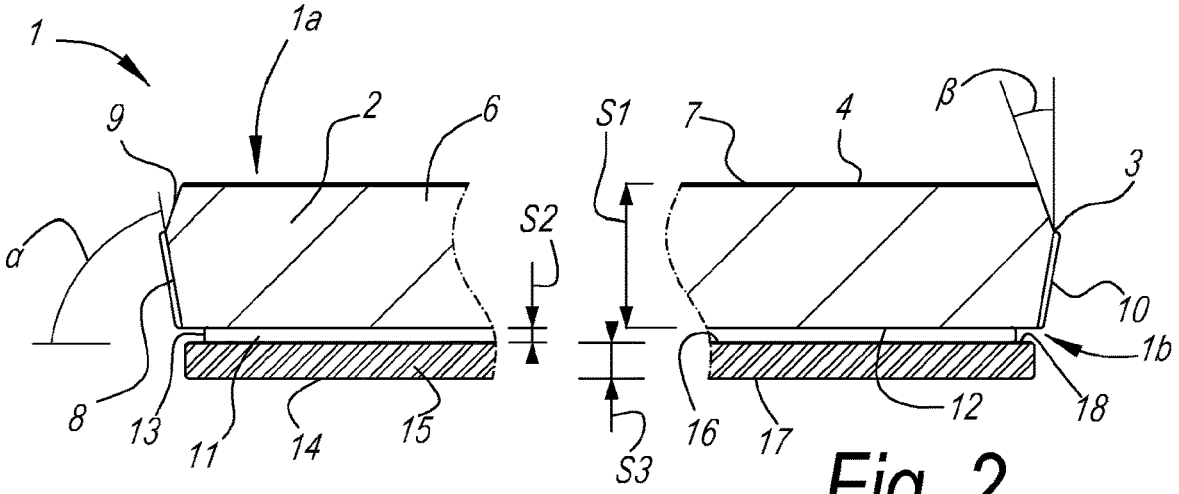
FIG. 2 schematically shows an enlargement of the cross section taken along the plane II-II of FIG. 1.

FIG. 2 shows an enlargement of the cross section taken along the plane II-II of FIG. 1. As shown in FIG. 2, the tile 2 of the example comprises a body 6 of ceramic material and a covering layer 7 that covers the upper surface of the body 6. For example, the covering layer 7 comprises at least a glaze, an engobe, a smaltobbio and/or a grog. The covering layer 7 substantially defines the upper surface 4 of the tile 2. The pattern is advantageously produced in, on top of, or under the covering layer. In the preferred embodiment, the body 6 has a color which is similar, or preferably identical, to that of the pattern 5, for example with the same color as the glaze. The tile 2 has a thickness S1 of between 4 and 30 mm, preferably between 5 and 12 mm.

In the example shown in FIG. 2, the edges 3 of the tile 2 comprise a lower bevel 8 and an upper bevel 9. In particular, the lower bevel 8 occupies a lower portion of the edge 3, for example two thirds of the thickness S1, while the upper bevel 9 occupies an upper portion del edge 3, for example one third of the thickness S1 of the tile 2. The lower bevel 8, in use, forms an angle $\alpha$ with the horizontal plane which is less than 90°, for example less than 85°. The upper bevel 9, in use, forms an angle ß with a vertical plane which is less than 90°, for example less than 90°, or preferably less than 45°.

DETAILED DESCRIPTION OF THE INVENTION

The covering element 1 further comprises a lining 10 of the edges 3 of the tile 2. In the preferred example shown in the figure, the lining 10 is configured to cover only the lower bevel 8. Preferably, the lining 10 is made of a polymeric material, preferably thermoplastic, for example PVC, PE or ABS. For example, the lining 10 is provided in the form of a strip of polymeric material glued to the edge 3. Advantageously, the lining 10 has a color capable of imitating, or preferably identical to, the color of the upper surface 4 and/or of the body 6 of the tile 2.

As shown in FIG. 2, the covering element 1 comprises a reinforcing element 11 configured to improve the mechanical strength of the tile 2; in particular, it is configured to increase the toughness of the tile 2. Even more particularly, the reinforcing element 11 compresses the body 6 of the tile 2 thereby improving the impact resistance of the tile 2 itself. The reinforcing element 11 is fixed to a lower surface 12 of the tile 2.

FIG. 2 shows a preferred embodiment in which the reinforcing element 11 comprises a metal sheet, made for example of steel, preferably galvanized or stainless steel. Preferably, the metal sheet of the reinforcing element 11 is configured to generate a compressive state in the tile 2, particularly starting from the lower surface 12 thereof. Thus, as the tile 2 is in a compressive state, a significant improvement in the impact resistance is obtained, since the compressive state impedes crack propagation. To achieve this objective, the reinforcing element 11 is initially put under tension (stretched or elongated) by means of mechanical or thermal stretching, and is then fixed under the tile 2 while still in the elongated state. The stretching is then released, by interrupting the mechanical stressing or cooling the reinforcing element, so as to put the tile 2 under compression.

According to the preferred embodiment, the metal sheet of the reinforcing element 11 has a coefficient of thermal expansion that is greater than the coefficient of thermal expansion of the tile 2. As a result of this solution, the metal sheet can be stretched by heating so as to expand in a substantially uniform manner in all directions. After the sheet of the reinforcing element is fixed under the tile 2, it may be cooled so as to contract and put the tile 2 under compression. Preferably, the metal sheet of the reinforcing element 11 has a Young's modulus that is greater than the Young's modulus of the tile 2, being for example two or three times the Young's modulus of the tile 2. Thus, when the elongated state of the reinforcing element 11 is released, the sheet can effectively put the tile 2 under compression. For example, said reinforcing element is applied according to the method described in the international application WO 2010/072704, which is incorporated herein by reference.

In a preferred embodiment, the reinforcing element 11 has a thickness S2 of between 0.05 mm and 1 mm, preferably between 0.05 mm and 0.5 mm, or even more preferably between 0.1 and 0.2 mm, for example 0.12 mm.

The reinforcing element 11 is fixed to a lower surface 12 of the tile 2, in particular of the body 6 thereof, by means of an adhesive, preferably a thermosetting resin, for example an epoxy, polyurethane, acrylic and/or hotmelt glue.

In the embodiment shown in FIG. 2, the reinforcing element 11 has substantially the same shape as the tile 2. In particular, the reinforcing element 11 has a slightly smaller horizontal size (in plan view) than that of the lower surface 12 of the tile 2. For example, the reinforcing element 11 has edges 13 that do not project beyond the edges 3 of the tile 2. That is to say, the edges 13 of the reinforcing element 11 are contained within the perimeter defined by the edges 3 of the tile 2.

It should be noted that, as shown by FIG. 2, the lower surface 12 of the tile 2 is usually smooth, that is to say free of relief structures, also known as a mark. Thus, the adhesion between the reinforcing element 11 and the lower surface 12 of the tile 2 is improved 22 so as to improve the reinforcing effect of the reinforcing element 11.

In the most preferred embodiment of the invention, illustrated herein, the reinforcing element 11 made of a metal sheet is magnetic receptive, for example may advantageously have ferromagnetic and/or paramagnetic characteristics, preferably ferromagnetic, so that it can be attracted by a magnetic element.

In FIG. 2, it is shown that an intermediate layer 14 is removably attached to the covering element 1 at its lower side 1*b*. The intermediate layer 14 comprises a polymeric sheet 15, for example made of chlorinated polyethylene elastomer, with magnetic particles, for example of strontium ferrite, embedded therein. In the most preferred embodiment, the intermediate layer 14 generates a magnetic field both its upper and lower surface 16 and 17.

As illustrated in FIG. 2, the intermediate layer 14 comprises on its upper surface 16 an adhesive coating 18 preferably a low-tack adhesive coating. In this way it is possible to combine the magnetic attraction with a low-tack adhesion to improve the adhesion between the covering element 1 and the intermediate layer 14. Moreover, the combination of the magnetic attraction with the low-tack adhesion allows the reduction of the intensity of the magnetic field thereby limiting the cost of the intermediate layer 14. Said adhesive coating 18 can comprise, for example, a polyurethane resin, polyaspartic resin, acrylic resin, epoxy resin.

The intermediate layer 14 shows a thickness S3 of at least 0.2 mm, preferably at least 1 mm and of maximum 2 mm, preferably maximum 1.5 mm.

Preferably, the intermediate layer 14 shows shape and/or dimension substantially corresponding to the shape and/or dimension of the covering element 1. For example, the intermediate layer 14 has a dimension that is suitable to cover at least the 80% of the lower surface of the covering element 1.

Figure 3:
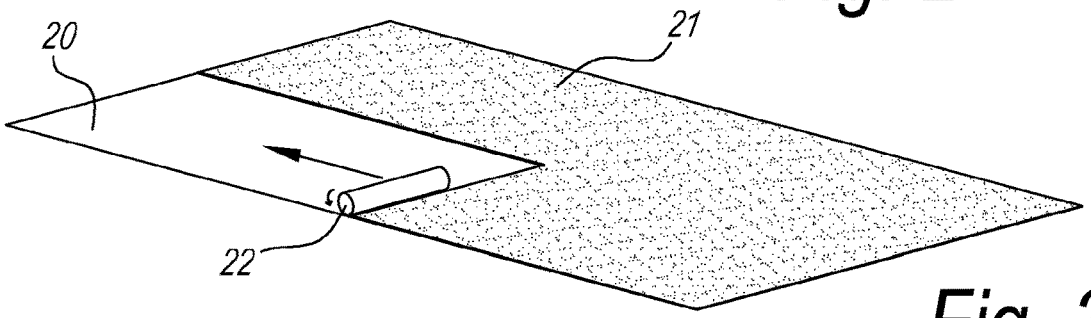
FIG. 3 schematically shows a first step of a method according to an aspect of the invention.

FIG. 3 shows a first step of a method for installing the covering element 1 on a subfloor, in this case a screed 20. In this first step a thinset composition 21 is spread on the screed 20, for example by means of a trowel or a roller 22. During this first step the thinset composition 21 is uncured and is in a liquid or pasty state.

In the preferred example the thinset composition 21 is a combination of an organic-based composition and resin-based composition. The cement-based composition can comprise one or more of cementitious component like, Portland cement, calcium-based cement, for example calcium-sulphate based cement, aluminum-based cement, and/or fillers, preferably inorganic fillers, like clays or silica. The resin-based composition can comprise acrylic or epoxy composition.

In the preferred embodiment, the thinset composition 21 comprises magnetic receptive particles, for example ferro silicon particle and/or magnetite that can be attracted by the intermediate layer 14.

In the preferred embodiment, the thinset composition 21 comprises at least the 20% wt (by weight), preferably at least the 30% wt of cement-based composition, at least 20% wt (by weight), preferably at least the 30% wt of resin-based composition, and at least 20% wt (by weight), preferably at least the 30% wt of magnetic receptive element.

The thinset composition 21 has a setting time between 5 h and 30 minutes.

Figure 4:
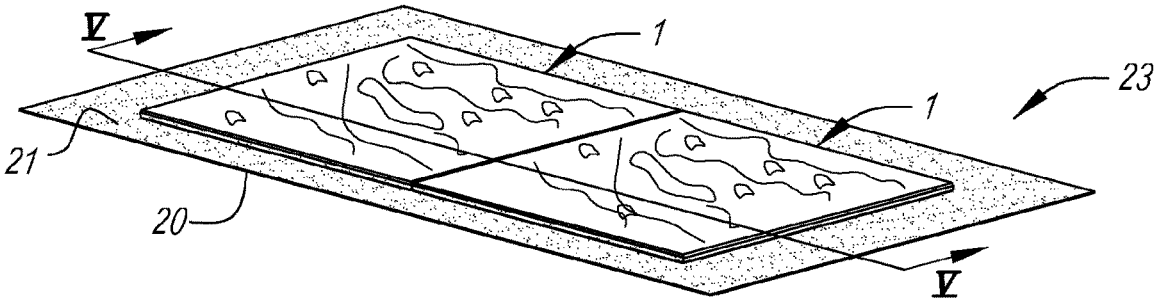
FIG. 4 schematically shows a second step of the method according to an aspect of the invention, and further schematically shows a surface covering according to another aspect of the invention.
Figure 5:
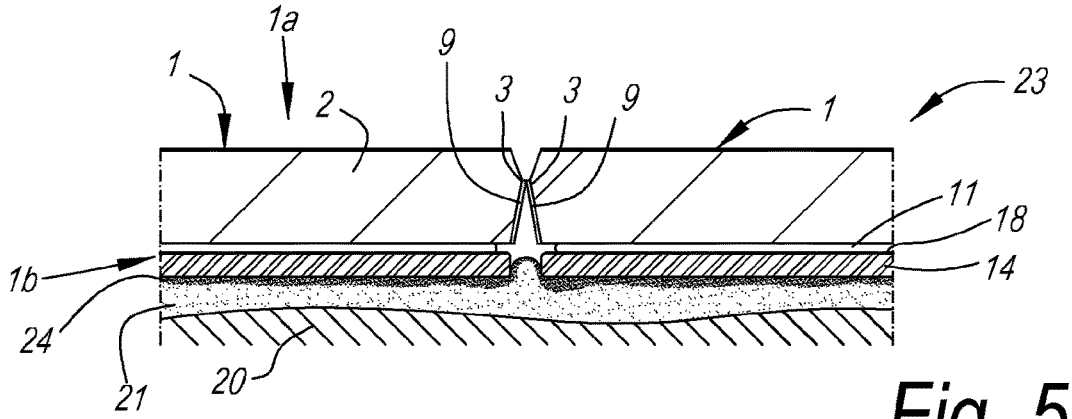
FIG. 5 schematically shows an enlargement of the cross section taken along the plane V-V of FIG. 4.

FIGS. 4 and 5 show a second step of the method of the invention wherein the covering elements 1 are installed on the thinset composition 1 for forming a floor covering 23. It is important to note that the covering elements 1 are installed on the thinset composition 21 when the latter is uncured or partially cured. Moreover, in this second step of the method, the intermediate layer 14 is removably attached to the covering element 1 so to enter in direct contact with the thin set composition 21 and prevents the contact between the covering element 1 and the thinset composition 21 itself.

The intermediate layer 14 magnetically attracts the magnetic receptive particles of the thinset composition 21 so that they will concentrate in an upper portion 24 thereof thereby maximizing the bonding between the intermediate layer 14 and the thinset composition 21.

The magnetic attraction exerted by the intermediate layer 14 and the low tach adhesive attraction exerted by the adhesive coating 18 keep the covering elements 1 in position in the floor covering 23 even in case of an heavy traffic.

Thanks to the fact that when the covering elements 1 are installed on the thinset composition when this is still in an uncured state, it is possible to adjust their position and/or the quantity of the thinset composition 21 below them to correct unevenness of the screed 20 to make sure that a well levelled floor covering 23 is obtained. For example, the upper surfaces 4 of the tiles 2 can lay all on a same plane. This can also be obtained with the help of levelling tools as wedges for example.

As shown in FIG. 5, the edges 3 of the covering elements 1 contact each other, in particular in correspondence of the linings 10. In this case, the covering element are not fixed each other and, since they are only removably attached to the intermediate layer 14, they can be removed from the floor covering 23 and reused.

Figure 6:
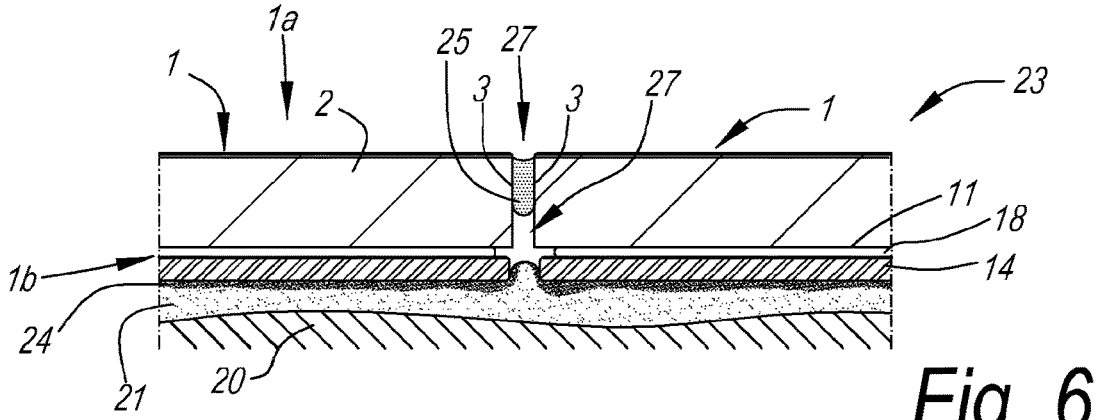
FIG. 6 shows the same view of FIG. 5 in an alternative embodiment of the invention.

FIG. 6 shows an alternative embodiment of the invention wherein the tiles 2 have edges 3 that are free from said linings 10 and wherein a joint 25 between said edges 3 is partially filled by a grout 26, preferably polymer based. Preferably the grout 26 is provided in the joint 25 only once the setting time of the thinset composition 21 is expired.

The grout 26 is provided in the joint 25 in such a way that an interspace 27 is formed between the thinset composition 21 and the grout 26. In this way, the grout 26 can be cut and the covering elements 1 removed without that the thinset composition 21 and/or the intermediate layer 14 are contaminated by the grout 26.

Figure 7:
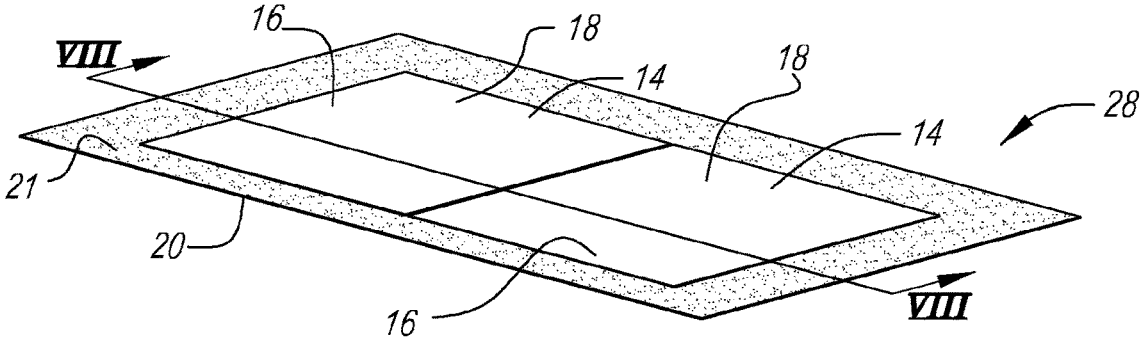
FIG. 7 schematically shows the floor of FIG. 4 in a special configuration.
Figure 8:
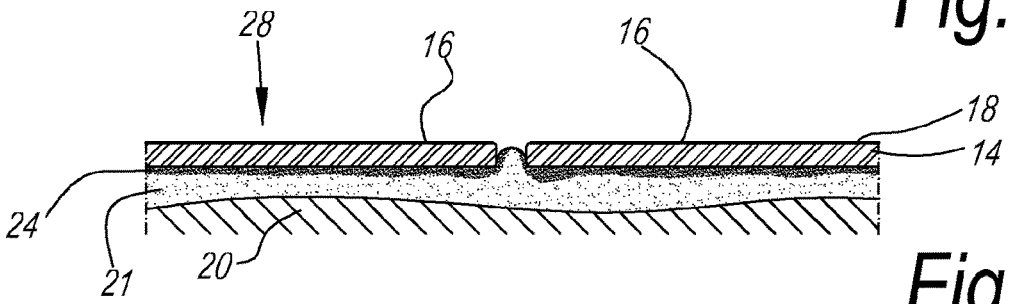
FIG. 8 schematically shows an enlargement of the cross section taken along the plane VIII-VIII of FIG. 6.

As shown in FIGS. 7 and 8, once once the setting time of the thinset composition 21 is expired the intermediate layer 14 remains solidly bonded to the thinset composition. Therefore, the covering elements 21 can be removed from the floor covering 23 but the intermediate layers 14 remains bonded to the thinset composition 21 so that the latter two form a subfloor system 28 that is ready to receive new covering elements 1, for example with a different décor 5. As shown in FIG. 8 the upper surface of said subfloor system 28 is substantially formed by the upper surfaces 16 of the intermediate layers 14 which lay substantially all on the same plane as a consequence of the fact that they have been placed on the thinset composition when the latter was in uncured state and when they were attached to the covering elements 1.

The present invention is in no way limited to the hereinabove described embodiments, but may be realized according to different variants without leaving the scope of the present invention.

Further, as is clear from the content of the description, the present invention relates to one or more of the items as listed below, numbered from 1 to 53:

1.—A method for installing a floor covering comprising the steps of:

providing a thinset composition (21) on top of a subfloor (20)

providing a covering element (1) on top of said thinset composition (1) when the thinset composition (21) is in an uncured or partially cured state, wherein said covering element (1) has an upper side and a lower side (1*b*) and is removably attached to an intermediate layer (14) at its lower side (1*b*), so that said intermediate layer (14) enters into contact with the thinset composition (21).

2.—The method according to item 1, wherein after curing of the thinset composition (1) the intermediate layer (14) is bonded to the thinset composition (21).

3.—The method according to any of the preceding items, wherein the covering element (1) has a magnetic or magnetic receptive element (11) on its lower side (1*b*) and said intermediate layer (14) comprises a magnetic or magnetic receptive layer.

4.—The method according to item 3, wherein the intermediate layer (14) is configured to generate a magnetic field on both its surfaces (16, 17).

5.—The method according to item 3 or 4, wherein the intermediate layer (14) comprises a polymer sheet (15) with magnetic or magnetic receptive particles.

6.—The method according to any of the items from 3 to 5, wherein the intermediate layer (14) is formed by one layer.

7.—The method according to any of the items from 3 to 6, wherein the magnetic receptive element on the lower side (1*b*) of the covering element (1) comprises a metal sheet (11).

8.—The method according to any of the preceding items, wherein the thinset composition (21) comprises a magnetic or magnetic receptive element 9.—The method according to item 8, wherein said thinset composition (21) comprises at least 20% wt (by weight), preferably at least the 30% wt of magnetic receptive or magnetic element.

10.—The method according to item 8 or 9, wherein the thinset composition (21) comprises a cement-based and/or a resin-based composition.

11.—The method according to item 10, wherein the thinset composition (21) comprises at least the 20% wt (by weight), preferably at least the 30% wt of cement-based composition; and/or at least 20% wt (by weight), preferably at least the 30% wt of resin-based composition.

12.—The method according to any of the preceding items, wherein the covering element (1) comprises a tile (2) made of a brittle material like: ceramic, natural stone, mineral-based tile, cement-based tile or glass.

13.—The method according to item 12, wherein the covering element (1) comprises a reinforcing element (11) configured for improving the impact resistance of the tile (2).

14.—The method according to item 13, wherein the reinforcing element (11) compresses the tile (2).

15.—The method according to any of the preceding items, wherein the intermediate layer (14) has substantially the same planar shape and/or planar dimension of the covering element (1).

16.—The method according to any of the preceding items, wherein the intermediate layer (14) comprises an adhesive or low tack adhesive coating (18) on one of its surfaces.

17.—The method according to any of the preceding items, wherein the covering element (1) comprises an edge (3) and a lining (10) at least partially covering said edge (3).

18.—The method according to item 17, wherein said lining (10) covers at least a lower bevel (8) of said edge (3).

19.—The method according to any of the items from 1 to 16, wherein the method comprises the step of grouting (26) a joint (25) between edges (3) of adjacent covering elements (1).

20.—The method according to item 19, wherein an intermediate space (27) is formed between said grout (26) and said thinset composition (21) and/or said intermediate layer (14).

21.—A floor covering (23) comprising:
a thinset composition (21) on a subfloor (20)
a covering element (1)
wherein said covering element (1) has an upper side and a lower side (1*b*) and is removably attached to an intermediate layer (14) at its lower side (1*b*).

22.—The floor covering (23) according to item 21, wherein the intermediate layer (14) is bonded to the thinset composition (21).

23.—The floor covering (23) according to item 21 or 22, wherein the covering element (1) has a magnetic or magnetic receptive element (11) on its lower side (1*b*) and said intermediate layer (14) comprises a magnetic or magnetic receptive layer.

24.—The floor covering (23) according to item 23, wherein the intermediate layer (14) is configured to generate a magnetic field on both its surfaces (16,17).

25.—The floor covering (23) according to item 23 or 24, wherein the intermediate layer (14) comprises a polymer sheet (15) with magnetic or magnetic receptive particles.

26.—The floor covering (23) according to any of the items from 23 to 25, wherein the intermediate layer (14) is formed by one layer.

27.—The floor covering (23) according to any of the items from 23 to 26, wherein the magnetic receptive element on the lower side (1*b*) of the covering element (1) comprises a metal sheet (11).

28.—The floor covering (23) according to any of the items from 21 to 27, wherein the thinset composition (21) comprises a magnetic or magnetic receptive element 29.—The floor covering (23) according to item 28, wherein said thinset composition (21) comprises at least 20% wt (by weight), preferably at least the 30% wt of magnetic receptive or magnetic element.

30.—The floor covering (23) according to item 28 or 29, wherein the thinset composition (21) comprises a cement-based and/or a resin-based composition.

31.—The floor covering (23) according to item 30, wherein the thinset composition (21) comprises at least the 20% wt (by weight), preferably at least the 30% wt of cement-based composition; and/or at least 20% wt (by weight), preferably at least the 30% wt of resin-based composition.

32.—The floor covering (23) according to any of the items from 21 to 31, wherein the covering element (1) comprises a tile (2) made of a brittle material like: ceramic, natural stone, mineral-based tile, cement-based tile or glass.

33.—The floor covering (23) according to item 32, wherein the covering element (1) comprises a reinforcing element (11) configured for improving the impact resistance of the tile (2).

34.—The floor covering (23) according to item 33, wherein the reinforcing element (11) compresses the tile (2).

35.—The floor covering (23) according to any of the items from 21 to 34, wherein the intermediate layer (14) has substantially the same planar shape and/or planar dimension of the covering element (1).

36.—The floor covering (23) according to any of the items from 21 to 35, wherein the intermediate layer (14) comprises an adhesive or low tack adhesive coating (18) on one of its surfaces (16, 17).

37.—The floor covering (23) according to any of the items from 21 to 36, wherein the covering element (1) comprises an edge (3) and a lining (10) at least partially covering said edge (3).

38.—The floor covering (23) according to item 37, wherein said lining (10) covers at least a lower bevel (8) of said edge (3).

39.—The floor covering (23) according to any of the items from 1 to 16, wherein it comprises a grout (26) at least partially filling a joint (25) between edges (3) of adjacent covering elements (1).

40.—The floor covering (23) according to item 21, wherein an intermediate space (27) is present between said grout (26) and said thinset composition (21) and/or said intermediate layer (14).

41.—A covering element (1) for floors covering (23) having an upper side and a lower side (1*b*) and that is removably attached to an intermediate layer (14) at its lower side (1*b*).

42.—The covering element (1) according to item 41, wherein it comprises a magnetic or magnetic receptive element (11) on its lower side (1*b*) and wherein said intermediate layer (14) comprises a magnetic or magnetic receptive layer.

43.—The covering element (1) according to item 42, wherein the intermediate layer (14) is configured to generate a magnetic field on both its surfaces (16,17).

44.—The covering element (1) according to item 42 or 43, wherein the intermediate layer (14) comprises a polymer sheet (15) with magnetic or magnetic receptive particles.

45.—The covering element (1) according to any of the items from 42 to 44, wherein the intermediate layer (14) is formed by one layer.

46.—The covering element (1) according to any of the items from 42 to 46, wherein the magnetic receptive element on the lower side (1*b*) of the covering element (1) comprises a metal sheet (11).

47.—The covering element (1) according to any of the items from 41 to 46, wherein it comprises a tile (2) made of a brittle material like: ceramic, natural stone, mineral-based tile, cement-based tile or glass.

48.—The covering element (1) according to item 47, wherein the covering element (1) comprises a reinforcing element (11) configured for improving the impact resistance of the tile (2).

49.—The covering element (1) according to item 48, wherein the reinforcing element (11) compresses the tile (2).

50.—The covering element (1) according to any of the items from 41 to 49, wherein the intermediate layer (14) has substantially the same planar shape and/or planar dimension of the covering element (1).

51.—The covering element (1) according to any of the items from 41 to 50, wherein the intermediate layer (14) comprises an adhesive or low tack adhesive coating (18) on one of its surfaces (16, 17).

52.—The covering element (1) according to any of the items from 41 to 51, wherein it comprises an edge (3) and a lining (10) at least partially covering said edge (3).

53.—The covering element (1) according to item 52, wherein said lining (10) covers at least a lower bevel (8) of said edge (3).

The invention claimed is:

1. A method for installing a floor covering comprising the steps of:

providing a thinset composition on top of a subfloor, wherein the thinset composition comprises one of a magnetic and a magnetic receptive element;

providing a covering element on top of said thinset composition when the thinset composition is in an uncured or partially cured state, wherein said covering element has an upper side and a lower side and is removably attached to an intermediate layer at the lower side of the covering element, so that said intermediate layer enters into contact with the thinset composition, wherein the intermediate layer has substantially the same planar shape and planar dimension of the covering element, and wherein the covering element has a magnetic or magnetic receptive element on the lower side of the covering element and said intermediate layer comprises one of a magnetic and a magnetic receptive layer.

2. The method according to claim 1, wherein after curing of the thinset composition the intermediate layer is bonded to the thinset composition.

3. The method according to claim 1, wherein the magnetic receptive element on the lower side of the covering element comprises a metal sheet.

4. The method according to claim 1, wherein the thinset composition comprises one of a cement-based composition, a polymer-based composition, and a combination thereof.

5. The method according to claim 1, wherein the covering element comprises a ceramic tile.

6. The method according to claim 5, wherein the covering element comprises a reinforcing element configured for improving the impact resistance of the ceramic tile.

7. The method according to claim 6, wherein the reinforcing element compresses the ceramic tile.

8. The method according to claim 1, wherein the intermediate layer comprises one of an adhesive and an adhesive coating on one of the surfaces of the intermediate layer.

9. The method according to claim 1, wherein the covering element comprises an edge and a lining at least partially covering said edge.

10. A floor covering comprising:

a thinset composition on a subfloor, wherein the thinset composition comprises one of a magnetic and a magnetic receptive element;

a covering element comprising a ceramic tile wherein said covering element has an upper side and a lower side and is removably attached to an intermediate layer at the lower side of the covering element, wherein the intermediate layer has substantially the same planar shape and planar dimension of the covering element; and wherein the covering element has a magnetic or magnetic receptive element on the lower side of the covering element and said intermediate layer comprises one of a magnetic and a magnetic receptive laver.

11. The floor covering according to claim 10, wherein the intermediate layer is bonded to the thinset composition.

12. The floor covering according to claim 11, wherein the covering element has one of a magnetic and a magnetic receptive element on the lower side of the covering element and said intermediate layer comprises one of a magnetic and a magnetic receptive layer, wherein the intermediate layer is configured to generate a magnetic field on both surfaces of the intermediate layer.

13. The floor covering according to claim 12, wherein the magnetic receptive element on the lower side of the covering element comprises a metal sheet.

14. The floor covering according to claim 10, wherein the thinset composition comprises one of a magnetic and a magnetic receptive element.

* * * * *